US008863995B2

(12) United States Patent
Stegeman

(10) Patent No.: US 8,863,995 B2
(45) Date of Patent: Oct. 21, 2014

(54) SPRAY CAP

(75) Inventor: Gerrit Jan Stegeman, Lochem (NL)

(73) Assignee: Plasticum Group B.V., Tilburg (NL)

( * ) Notice: Subject to any disclaimer, the term of this patent is extended or adjusted under 35 U.S.C. 154(b) by 1166 days.

(21) Appl. No.: 12/740,143

(22) PCT Filed: Oct. 22, 2008

(86) PCT No.: PCT/NL2008/000237
§ 371 (c)(1),
(2), (4) Date: Jun. 7, 2010

(87) PCT Pub. No.: WO2009/058000
PCT Pub. Date: May 7, 2009

(65) Prior Publication Data

US 2011/0240683 A1 Oct. 6, 2011

(30) Foreign Application Priority Data

Oct. 31, 2007 (EP) ..... 07075944

(51) Int. Cl.
*B65D 83/00* (2006.01)
*B65D 83/20* (2006.01)

(52) U.S. Cl.
CPC ..... *B65D 83/205* (2013.01)
USPC ..... 222/402.13

(58) Field of Classification Search
CPC ..... B65D 83/20
USPC ..... 222/402.1–402.25
See application file for complete search history.

(56) References Cited

U.S. PATENT DOCUMENTS 3,991,916 A * 11/1976 Del Bon ..... 222/402.13
5,779,109 A * 7/1998 Gueret ..... 222/494

(Continued)

FOREIGN PATENT DOCUMENTS

DE 20007784 U1 9/2001
DE 10125958 A1 12/2001
GB 2402176 A 12/2004

OTHER PUBLICATIONS

English Abstract of DE 10125958.

*Primary Examiner* — Paul R Durand
*Assistant Examiner* — Randall Gruby
(74) *Attorney, Agent, or Firm* — John S. Sopko; Hoffmann & Baron, LLP

(57) ABSTRACT

The invention relates to a spray cap for placement on top of an aerosol container of the type that has a spray valve disposed at the top of the container and a valve stem extending upwardly therefrom for actuating the valve. The spray cap comprises a cap body with a spray nozzle and a tubular member defining a spray channel arranged within the cap body. The spray channel on one end is in communication with the spray nozzle. The tubular member has a first portion which is hingedly attached to the cap body in a region adjacent the spray nozzle. The tubular member furthermore has a second portion which is angular with the first portion and which, when the spray cap is mounted on a container, extends concentrically with the valve stem of the container and is connected therewith. The cap further comprises an actuating member connected to the tubular member, such that when the actuating member is operated, the tubular member is hinged downward and the second portion of the tubular member forces down the valve stem thereby opening the valve of the container. The tubular member, in the first portion thereof, comprises at least one flexible section which is more flexible than the remainder of the tubular member, which results in that the deformation of the tubular member is easier causing the second portion of the tubular member is easier maintained in line with the valve stem.

11 Claims, 1 Drawing Sheet

(56) References Cited

U.S. PATENT DOCUMENTS

| | | | | |
|---|---|---|---|---|
| 6,016,939 | A * | 1/2000 | Gueret | 222/494 |
| 6,497,346 | B1 * | 12/2002 | Dubois et al. | 222/494 |
| 6,991,139 | B2 * | 1/2006 | Garcia et al. | 222/494 |
| 7,530,476 | B2 * | 5/2009 | Downey et al. | 222/153.11 |
| 2003/0089734 | A1 * | 5/2003 | Eberhardt et al. | 222/39 |
| 2004/0149781 | A1 * | 8/2004 | Kunesh et al. | 222/402.1 |
| 2005/0006416 | A1 * | 1/2005 | Garcia et al. | 222/402.12 |
| 2005/0133542 | A1 | 6/2005 | Kolanus | |
| 2006/0027595 | A1 * | 2/2006 | Eberhardt et al. | 222/39 |
| 2007/0138214 | A1 * | 6/2007 | De'Padova et al. | 222/402.13 |
| 2007/0164056 | A1 * | 7/2007 | Eberhardt et al. | 222/402.13 |
| 2007/0235474 | A1 * | 10/2007 | Downey et al. | 222/153.11 |
| 2008/0093380 | A1 * | 4/2008 | Geiberger et al. | 222/108 |
| 2009/0314810 | A1 * | 12/2009 | Neuhaus | 222/402.13 |
| 2010/0012680 | A1 * | 1/2010 | Canfield et al. | 222/207 |
| 2010/0147898 | A1 * | 6/2010 | Blumenstein et al. | 222/402.13 |
| 2012/0111898 | A1 * | 5/2012 | Neuhaus | 222/402.13 |
| 2014/0091109 | A1 * | 4/2014 | Canfield et al. | 222/207 |

* cited by examiner

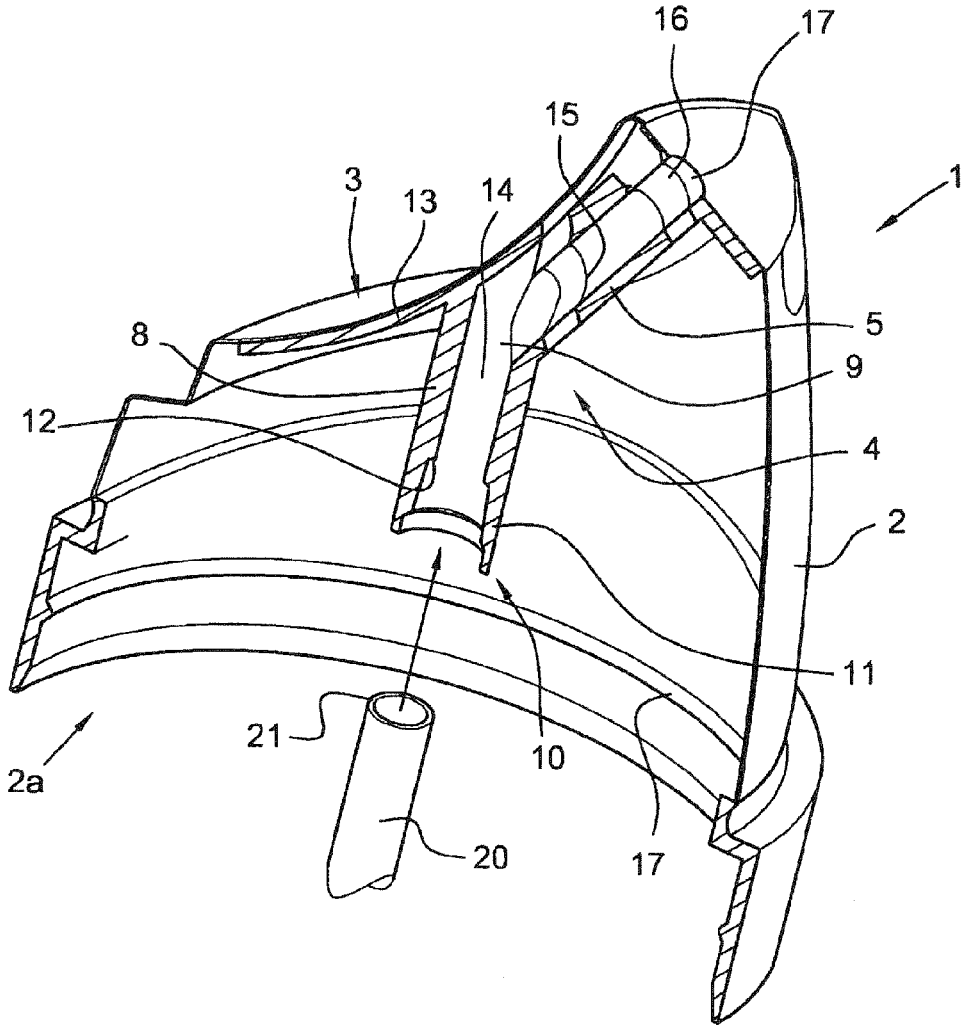
16
17
15
1
3
13
14
5
8
9
12
4
2
11
21
10
2a
20
17

SPRAY CAP

CROSS-REFERENCE TO RELATED APPLICATIONS

This application is the National Stage of International Application No. PCT/NL2008/000237, filed Oct. 22, 2008, which claims the benefit of European Application No. 07075944.4, filed Oct. 31, 2007, the contents of which is incorporated by reference herein.

FIELD OF THE INVENTION

The present invention relates to a spray cap for placement on an aerosol container of the type that has a spray valve disposed at the top of the container and a valve stem extending therefrom in an axial direction for actuating the valve. The spray cap comprises a cap body with a spray nozzle and a tubular member arranged within the cap body. The tubular member defines a spray channel that on one end is in communication with the spray nozzle and, when placed on the aerosol container, on its other end is in communication with the valve stem. The tubular member furthermore has a first portion which is hingedly attached to the cap body in a region near the spray nozzle, and a second portion which extends at an angle with the first portion and which, when the spray cap is mounted on an aerosol container, extends concentrically with the valve stem of the aerosol container and is connected therewith. The spray cap further comprises an actuating member connected to the tubular member, such that when the actuating member is operated, the tubular member is hinged towards the top of the aerosol container and the second portion of the tubular member forces down the valve stem thereby opening the valve of the aerosol container and allowing the content of the container to flow through the valve stem into the spray channel towards the spray nozzle.

Such a spray cap is known and can be found on the market. An example is shown in EP 1 309 500, although that publication does not show or describe the inside of the spray cap. Upon pressing with a finger on the actuating means of the known spray cap, the tubular member defining the spray channel is tilted and the portion of the tubular member, which is connected to the valve stem, is moved downwardly. The valve stem is thereby moved downwardly, resulting in the opening of the valve.

In EP 863 089 is disclosed another spray cap with a spray channel and actuating means. The spray cap has a tubular member which on the end near the spray nozzle is more or less rigidly connected to the cap body. Upon pressing with a finger on the actuating means of the spray cap, the cap body locally deforms and thereby the tubular member defining the spray channel is tilted and the portion of the tubular member, which is connected to the valve stem, is moved downwardly and transversely. The valve stem is thereby moved downwardly and transversely, thereby opening the valve.

In US 2005/0133542 is disclosed a different spray cap for an aerosol, which spray cap is assembled from a plastic base and a cap. The cap has a dispensing opening and has a top surface for finger actuation. The base comprises an upper portion and a lower portion which are connected by a plurality of thin tab hinges. The base includes a centrally located tube defining a channel with a bottom region for engagement with the aerosol valve stem. The tube has a horizontal portion which extends to a dispensing opening in the base. The cap is slideable with respect to the base upon depression of the top surface of the cap until the spray openings in the cap and the base are aligned. Upon further depression of the top surface of the cap, the tube presses the valve stem downwardly and opens the valve. The tube is stationary with respect to the upper base portion and therefore does not tilt upon depression of the top surface of the cap. The horizontal part of the tube is made of TPE so as to allow expansion of the tube when a foaming product is post foaming after the tube has been closed. Thereby no post foaming is taking place outside the cap opening.

In some applications it is undesirable that a transverse force is applied by the tubular member of a spray cap on the valve stem of an aerosol. In particular this is the case where the valve stem of the aerosol is not tiltable and only moveable in its axial direction. While the spray cap as disclosed in US 2005/0133542 would alleviate this problem because its tubular member is only allowed to move axially without tilting, this known solution proposes a much too complex design with a multiple part spray cap.

In the much simpler spray cap designs as disclosed in EP 863 089 or EP 1 309 500 the valve stem forces the portion of the tubular member connected thereto to move axially. However, the tendency of said portion of the tubular member to move transversely causes a deformation of said tubular member, which makes the spray operating mechanism heavy to operate. Furthermore it causes friction between the spray channel and the valve stem, which also makes the spray mechanism heavier to operate. Moreover, the transverse forces can cause that the tubular member and the valve stem get disconnected, which could cause the content of the aerosol to escape into the space under the spray cap.

It is an object of the invention to provide an improved spray cap of the type as described at the outset.

SUMMARY OF THE INVENTION

This object is achieved by a spray cap for placement on an aerosol container as described at the outset, wherein the tubular member, in the first portion thereof, comprises at least one flexible section which is more flexible than the remainder of the tubular member.

The flexible section in the tubular member provides an additional hinge area in the tubular member. This results in that the deformation of the tubular member is easier causing the second portion of the tubular member is easier maintained in line with the valve stem. This results in a reduced actuating force necessary to operate the spray mechanism.

Preferred embodiments of the invention are defined in the dependent claims.

The invention will now be described in more detail in the following description with reference to the drawing.

BRIEF DESCRIPTION OF THE DRAWING

FIG. 1 shows in perspective a sectional view of a preferred embodiment of a spray cap according to the invention.

DETAILED DESCRIPTION

In the figure a spray cap 1 is shown which comprises a cap body 2 which is open on the lower side 2*a*. The cap body 2 has a closed outer surface. The open lower side of the cap body 2 can be placed over an upper side of a aerosol container and can be connected therewith in a manner known per se for instance by a snap connection by means of e.g. a inwardly extending annular rib 17. The aerosol container, which is not shown in the figure, has on the top side a valve which commonly has a valve body and a valve seat, wherein the valve body is biased against the valve seat by a spring into a closed position. The valve can be opened by pressing a valve stem 20, which is connected to the valve body, in the direction against the spring force, usually inwardly over for instance a distance of about 2 mm. The valve stem 20 is a tubular member through which the content of the container, e.g. hair spray, deodorant, or cleaning agent flowing through the opened valve can flow out.

On the upper side the cap body 2 has an actuating area 3. This actuating area 3 is preferably made of a flexible material, preferably a thermoplastic elastomer, preferably TPE, which gives the actuating area a soft touch. The cap body 2 is apart from the actuating area 3 made of a stiffer thermoplastic material, preferably PP. The actuating area 3 and the remainder of the cap body 2 together form the closed outer surface of the cap.

In the spray cap 1 is arranged an angled tubular member 4 defining a spray channel 14. The tubular member 4 has a first portion 5 that is on one end 6 connected to the cap body 2 where the spray channel 14 is in communication with a spray nozzle 7. The first portion 5 is on its other end connected to a second portion 8 through an angled portion 9. The second portion 8 of the tubular member 4 extends axially with the central axis of the cap body 2 and with the valve stem 20 of the aerosol container. The second portion 8 has a free end 10 with an end region 11 with a greater inner diameter than the remainder of the second portion 8, such that an annular stop surface 12 is created that in use rests on the upper end surface 21 of the valve stem 20 of the aerosol container.

An actuating member 13 is attached to the tubular member 4 and is in the preferred embodiment integral therewith. The actuating member 13 is preferably made of a thermoplastic material, more preferably of PP. The actuating area 3 of flexible material covers the upper side of the actuating member 13 and is attached thereto.

The tubular member 4 comprises in the first portion 5 thereof, at least one flexible section 15 which is more flexible than the remainder of the tubular member 4. The flexible section 15 has a tubular shape. In the embodiment shown it extends over a part of the length of the first portion 5 of the tubular member 4. Preferably the flexible section 15 is located near the angle portion 9 of the tubular member 4. The flexible section 15 is preferably made of the same material as the actuating area, most preferably of TPE. The flexible section 15 acts as a hinge when the actuating member 13 is pressed by a user and the first portion 5 of the tubular member 4 bends. The hinging action of the flexible section 15 provides the effect that the second portion 8 of the tubular member 4 is not tilted and remains in its axial orientation, coaxial with the valve stem 20

In the preferred embodiment shown in the figure the first portion 5 of the tubular member 4 has a second flexible tubular section 16 which is located near the attachment area where the tubular member 4 is attached to the cap body 2. This second flexible section 16 constitutes a hinge when the actuating member 13 is pressed by the user. The provision of the second flexible section 16 results in that the tubular member is movable downwards with less force.

It is also contemplated to have more than two flexible sections in the first portion 5 of the tubular member 4. It is expressly noted however that also an embodiment with only one flexible section, although not shown in the drawing, is contemplated and considered to fall within the scope of the invention.

It is also contemplated to form the first portion to a great extent from a flexible material, e.g. TPE. In that case venturis can be formed, e.g. by providing ribs on the inner side of the first portion of the tubular member, whereby upon deformation of said first portion the discharge flow behavior can be influenced.

The spray cap 1 is preferably made in one piece by means of a two-component injection moulding process, in which in a first stage the thermoplastic parts, preferably of PP, of the cap are formed after which in another stage the flexible parts, preferably of TPE are formed.

The invention claimed is:

1. A spray cap for placement on an aerosol container of the type that has a spray valve disposed at the top of the container and a valve stem extending therefrom in an axial direction for actuating the valve, the spray cap comprising a cap body with a spray nozzle and a tubular member arranged within the cap body, the tubular member defining a spray channel that on one end is in communication with the spray nozzle and, when placed on the aerosol container, on its other end is in communication with the valve stem, the tubular member furthermore having a first portion which is hingedly attached to the cap body in a region near the spray nozzle, and a second portion which extends at an angle with the first portion and which—when the spray cap is mounted on an aerosol container—extends concentrically with the valve stem of the aerosol container and is connected therewith, and the spray cap further comprising an actuating member connected to the tubular member, such that when the actuating member is operated, the tubular member is hinged towards the top of the aerosol container and the second portion of the tubular member forces down the valve stem thereby opening the valve of the aerosol container and allowing the content of the container to flow through the valve stem into the spray channel towards the spray nozzle, wherein the tubular member comprises at least one flexible section which is more flexible than the remainder of the tubular member, said flexible section providing a hinge area in the tubular member.

2. The spray cap according to claim 1, wherein the cap body and the tubular member are made, at least partly, of a thermoplastic material, preferably PP, and wherein the flexible section is made of a thermoplastic elastomer, preferably TPE.

3. The spray cap according to claim 1, wherein the flexible section is located near the angle between the first portion and the second portion of the tubular member.

4. The spray cap according to claim 1, wherein the flexible section is integrally formed with the rest of the tubular member.

5. The spray cap according to claim 1, wherein the actuating member is formed integrally with the tubular member.

6. The spray cap according to claim 1, wherein the spray cap has an actuating area covering at least the actuating member, which actuating area is made of an elastomer, preferably TPE.

7. The spray cap according to claim 1, wherein the attachment of the first portion of the tubular member to the cap body is constituted by a flexible section so as to form the hinge.

8. The spray cap according to claim 1, wherein the spray cap is produced by a two-component injection moulding process.

9. The spray cap according to claim 1, wherein the flexible section is a tubular section.

10. The spray cap according to claim 1, wherein the flexible section extends over a length which is smaller than the length of the entire first portion of the tubular member.

11. The spray cap according to claim 1, wherein said flexible section is located in said first portion of the tubular member.

* * * * *